US005584678A

United States Patent [19]

Hirooka et al.

[11] Patent Number: 5,584,678

[45] Date of Patent: Dec. 17, 1996

[54] SCROLL TYPE FLUID MACHINE HAVING TIP SEALS OF DIFFERENT CARBON FIBER COMPOSITION RATES

[75] Inventors: Katsumi Hirooka, Nishi-Kasugai-gun; Hiroyuki Kobayashi, Nagoya; Susumu Matsuda, Nagoya, all of Japan

[73] Assignee: Mitsubishi Jukogyo Kabushiki Kaisha, Tokyo, Japan

[21] Appl. No.: 527,423

[22] Filed: Sep. 13, 1995

[30] Foreign Application Priority Data

Mar. 30, 1995 [JP] Japan ..... 7-074125

[51] Int. Cl.[6] ..... F01C 1/04; F01C 19/08

[52] U.S. Cl. ..... 418/55.2; 418/55.4; 418/142; 418/178

[58] Field of Search ..... 418/55.2, 55.4, 418/142, 152, 178

[56] References Cited

FOREIGN PATENT DOCUMENTS

| | | | |
|---|---|---|---|
| 63-158362 | 7/1988 | Japan | 418/55.4 |
| 3-92590 | 4/1991 | Japan | 418/55.4 |
| 3273083 | 12/1991 | Japan | 418/55.4 |
| 5240174 | 9/1993 | Japan | 418/55.2 |

*Primary Examiner*—John J. Vrablik

*Attorney, Agent, or Firm*—Wenderoth, Lind & Ponac

[57] ABSTRACT

A scroll type fluid machine has a pair of mutually engaged scrolls, one being made of an aluminum material, and the other being made hard. A wear amount of an engaging tip seal and end plate is reduced, and the growth of wear of both elements is equalized. Tip seals (47, 48) are provided at the tips of wraps (12, 16) of the pair of scrolls (10, 14) and are made of a composite plastic material composed of a polyphenylene sulfide as a base material and a carbon fiber, and other materials as filler. The carbon fiber composition rate of the tip seal material of the scroll (10) made of an aluminum material is made higher than the carbon fiber composition rate of the tip seal material of the other scroll (14) made of an aluminum material having a surface treatment or of a ferrous metal or of a ferrous metal having a surface treatment. Thereby the wear amount of each engaging tip seal (47, 48) and end plate (11, 15) is reduced, and simultaneously the growth of wear of both elements is equalized.

4 Claims, 5 Drawing Sheets

MATERIALS OF A TIP SEAL AND ITS CONTACTING SCROLL

| NUMERAL | NAME | MATERIALS | | NUMERAL | NAME | MATERIAL | SURFACE TREATMENT |
|---|---|---|---|---|---|---|---|
| | | BASE MATERIAL | FILLER | | | | |
| 47 | TIP SEAL | POLYPHENYLENE SULFIDE (PPS) | CARBON FIBER 20 wt% OTHERS | 14 | SWIVEL SCROLL | ALUMINUM | YES |
| 48 | TIP SEAL | -do- | CARBON FIBER 10 wt% OTHERS | 10 | STATIONARY SCROLL | -do- | NO |

FIG. 2

MATERIALS OF A TIP SEAL AND ITS CONTACTING SCROLL

| NUMERAL | NAME | MATERIALS | | NUMERAL | NAME | MATERIAL | SURFACE TREATMENT |
|---|---|---|---|---|---|---|---|
| | | BASE MATERIAL | FILTER | | | | |
| 17 | TIP SEAL | POLYPHENYLENE SULFIDE (PPS) | CARBON FIBER 15 wt% OTHERS | 14 | SWIVEL SCROLL | ALUMINUM | YES |
| 18 | TIP SEAL | -do- | -do- | 10 | STATIONARY SCROLL | -do- | NO |

FIG. 5
(PRIOR ART)

SCROLL TYPE FLUID MACHINE HAVING TIP SEALS OF DIFFERENT CARBON FIBER COMPOSITION RATES

BACKGROUND OF THE INVENTION

1. Field of the Invention

The present invention relates to a scroll type fluid machine used, for example, as a component in a refrigeration cycle, etc.

2. Description of the Prior Art

Recently, for air conditioning units, scroll type compressors (or scroll type fluid machines) in which a pair of mutually engaged spiral wraps are provided have been used because of their high efficiency operation.

In FIG. 4, an example of a heretofore known scroll type compressor is shown, and this scroll type compressor is now described. In FIG. 4, numeral 1 designates a hermetic housing. This hermetic housing 1 consists of a cup-like body 2, a front end plate 4 fixed thereto by bolts 3 and a cylindrical element 6 fixed thereto by bolts 5. A rotating shaft 7, passing through the cylindrical element 6, is supported rotatably by the housing 1 via a bearing 8 and a bearing 9.

Within the hermetic housing 1, a stationary scroll 10 (one of the pair of scroll elements) and a swivel scroll 14 engaged therewith (the other of the pair of scroll elements) are provided.

More particularly, the stationary scroll 10 has an end plate 11 and a spiral wrap 12 standing on its inner surface. The end plate 11 is fixed to the bottom side of the cup-like body 2 by bolts 13.

The outer circumferential surface of the end plate 11 and the inner circumferential surface of the cup-like body 2 sealingly contact each other, and thereby the inner space of the housing 1 is partitioned so that, in a space within the hermetic housing 1, a discharge cavity 31 is formed on the other side of the end plate 11 and a suction chamber 28 is formed on the inner side of the end plate 11.

Incidentally, at the central part of the end plate 11, a discharge port 29 is provided so as to be opened and closed by a discharge valve 30.

The swivel scroll 14 has an end plate 15 and a spiral wrap 16 standing on its inner surface. The spiral wrap 16 is of substantially the same shape as the spiral wrap 12 of the stationary scroll 10.

The swivel scroll 14 and the stationary scroll 10 are mutually engaged eccentrically by a length of a radius of revolution with a deviation angle of 180 degrees, as shown in the figure. On a tip surface of each spiral wrap 12, 16, a spiral tip seal 17, 18 is provided ridgedly along the spiral.

As to the fitting of the tip seal 17, a groove 17*a* is formed along the spiral on the tip surface of the spiral wrap 12, and the spiral tip seal 17 is inserted in the groove 17*a* so that a portion of one side of the tip seal 17 is projecting from the tip surface of the spiral wrap 12. Likewise as to the fitting of the tip seal 18, a groove 18*a* is formed along the spiral on the tip surface of the spiral wrap 16 and the spiral tip seal 18 is inserted in the groove 18*a* so that a portion of one side of the tip seal 18 is projecting from the tip surface of the spiral wrap 16.

The tip seal 17 os the spiral wrap 12 sealingly contact the inner surface of the end plate 15 of the opposite swivel scroll 14, and the tip seal 18 of the spiral wrap 16 sealingly contacts the inner surface of the end plate 11 of the opposite stationary scroll 10.

The side surfaces of the spiral wrap 12 and the spiral wrap 16 make line contacts at a plurality of places and thereby form a plurality of crescent compression chambers 19*a*, 19*b* (fluid chambers) at the positions between the wraps which have nearly a point symmetry with each other around the centers of the spirals.

Within a cylindrical boss 20 projecting at the central part of the outer surface of the end plate 15, a drive bush 21 is inserted rotatably via a rotary bearing 23. Within a slide groove 24 provided in the drive bush 21, an eccentric drive pin 25 is provided eccentrically to project at the inner end of the rotating shaft 7, and is inserted slidably. The drive bush 21 is fitted with a balance weight 27 for balancing dynamic unbalances caused by orbital swivel motions of the swivel scroll 14.

Incidentally, in FIG. 4, numeral 36 designates a thrust bearing provided between the circumferential edge of the outer surface of the end plate 15 and the inner surface of the front end plate 4, numeral 26 designates a rotation preventing mechanism consisting of an Oldham coupling for allowing orbital swivel motions of the swivel scroll 14 but preventing rotation thereof, and numeral 37 designates a balance weight fixed to the rotating shaft 7.

In a scroll type compressor so constructed, upon the rotating shaft 7 being driven, the swivel scroll 14 is driven via an orbital drive mechanism consisting of the eccentric drive pin 25, the drive bush 21, the cylindrical boss 20, etc.

Then the swivel scroll 14, being prevented from rotating by the rotation preventing mechanism 26, makes orbital swivel motions on a circular track having a radius of revolution, i.e. a radius which is an eccentric amount between the rotating shaft 7 and the eccentric drive pin 25.

Then, the line contact parts of the side surfaces of the spiral wrap 12 and of the spiral wrap 16 move gradually in the direction of the spiral centers. As a result, the compression chambers 19*a*, 19*b* move, with the volume thereof being reduced, in the direction of the spiral centers.

Accompanying such movement of the compression chambers 19*a*, 19*b*, a gas (fluid) flows into a suction chamber 28 through a suction inlet (not shown in the figure) and is taken into each of the compression chambers 19*a*, 19*b* from openings of the outer ends of the spiral wraps 12, 16 and, while being compressed, comes into the central chamber 22. Upon completion of compression, it passes through the discharge port 29 by pushing open the discharge valve 30, and the gas is discharged into the discharge cavity 31 and flows out through a discharge outlet (not shown in the figure).

Incidentally, the movement occurring at the swivel scroll 14 while it is making orbital swivel motions is allowed by the slide groove 24. I.e. while the swivel scroll 14 is making orbital swivel motions, it receives a centrifugal force acting in the direction of eccentricity and a gas pressure by the compressed gas in each of the compression chambers 19*a*, 19*b* and is pushed in the direction increasing the orbital radius.

With such motions, the side surfaces of the spiral wrap 16 of the swivel scroll 14 sealingly contact the side surfaces of the spiral wrap 12 of the stationary scroll 10, by which leakage of the gas from the compression chambers 19*a*, 19*b* is prevented. The motions of the swivel scroll 14 of which the orbital radius is about to change when the side surface of the spiral wrap 12 and the side surface of the spital wrap 16 are making sliding motions in each other while they are maintaining sealing contact are allowed by the eccentric drive pin 25, which makes sliding movements within the slide groove 24 in its longitudinal direction.

In a scroll type compressor, a weight reduction of both the stationary scroll 10 and the swivel scroll 14 is being pursued. For this purpose, in the prior art, the stationary scroll 10 and the swivel scroll 14 are mode of an aluminum material. The spiral wraps 12, 16 of both scrolls 10, 14 are also made of an aluminum material and the tip seals 17, 18 are made of a composite plastic material, as has so far been used, composed of a polyphenylene sulfide (PPS) as a base material and a carbon filter of 15 weight percent and others as a filler, and are used in combination.

However, the stationary scroll 10 and the swivel scroll 14 made of an aluminum material, if used, have the disadvantage that extreme wear occurs or a seizure can occur, etc.

Therefore, one of the scrolls has a hard surface treatment applied thereto. More concretely as shown in FIG. 5, one of the scrolls, for example, the movable swivel scroll 14, has a surface treatment applied on its surface such as an alumite (aluminum is anodized and an aluminum oxide coating is formed on the surface), a special alumite (aluminum is anodized, aluminum oxide coating is formed on the surface and a fluororesin etc. is impregnated on the surface), etc.

However, while a hard aluminum oxide coating is formed by this surface treatment on the inner surface of the end plate 15 of the swivel scroll 14, the surface roughness becomes worse than that of the aluminum material.

For this reason, upon the swivel scroll 14 being driven, the tip seal 17 of the stationary scroll 10 making sealing contact with the inner surface (the surface being made hard and the surface roughness being worsened by a surface treatment) of the end plate 15 of the swivel scroll 14, and the tip seal 18 of the swivel scroll 14 making sealing contact with the inner surface (soft surface of aluminum material itself) of the end plate 11 of the stationary scroll 10, make relative sliding motions between their respective components, and sliding wear occurs between the relative surfaces.

More concretely, at the portion where the top seal 17 of the stationary scroll 10, made of a composite plastic material (composed of a polyphenylene sulfide as a base material and a carbon fiber of 15 weight percent and others as a filler) and the end plate 15 of the swivel scroll 14 having a surface treatment make sealing contact (combination of a composite plastics and a treated surface), there occurs a considerable sliding wear on the side of the tip seal 17. Likewise at the portion where the tip seal 18 of the swivel scroll 14 and the end plate 11 of the stationary scroll 10 made of an aluminum material make sealing contact (a combination of a composite plastic and an aluminum material), there occurs a considerable wear on the side of the end plate 11. And yet gradually, a sliding wear grows quickly as the contact pressure becomes larger.

Therefore, if a compressor is operated in a state referred to as a high differential pressure operation, where the differential pressure of the discharge pressure and the suction pressure is large, as the contact pressure between the tips of tip seals 17, 18 and the inner surfaces of the end plates 11, 15 becomes larger, the wear of one component grows quickly. I.e. the wear of the tip seal 17 of the stationary scroll 10 and the wear of the inner surface of the end plate 11 of the stationary scroll 10 increases more quickly than that of the engaging swivel scroll 14, which leads to a problem in that the life of the product is hurt.

SUMMARY OF THE INVENTION

In view of the above-described problems inherent in the prior art, it is an object of the present invention to provide a scroll type fluid machine in which a pair of mutually engaged scroll element, one being made of an aluminum material, the other having a hardening treatment applied thereto, are provided and, while the wear amount of each engaging tip seal and end plate can be reduced, the degree of increase of wear of both components can be equalized.

For attaining the above object, the present invention has spiral tip seals provided at the tip surfaces of spiral wraps of a pair of scroll elements that are made of a composite plastic material composed of a polyphenylene sulfide as a base material and a carbon fiber and other materials as filler, and the carbon fiber composition rate of the tip seal material of one scroll element made of an aluminum material is made higher than the carbon fiber composition rate of the tip seal material of the other scroll element made of an aluminum material having a surface treatment or of a ferrous metal or of a ferrous metal having a surface treatment.

The present invention, further, in order to obtain an excellent effect of reducing the wear amount in addition to the object mentioned above, has the carbon fiber composition rate in a range of 17 to 50 weight percent with respect to the tip seal material of the scroll element made of an aluminum material and in the range of 3 to 12 weight percent with respect to the tip seal material of the other scroll element.

The present invention, furthermore, in order to obtain an excellent effect of reducing the wear amount to obtain the character of a tip seal material in addition to the object mentioned above, provided the other scroll element with a head coating treatment on its surface.

The present invention, in order to obtain a further excellent effect of reducing the wear amount and to obtain the character to a tip seal material, has the surface treatment set out above comprise an alumite treatment or a special alumite treatment.

According to the present invention, a tip seal fitted to a scroll element made of an aluminum material is made of a composite plastic material of a high carbon fiber composition rate and has an increased hardness and an enhanced wear resistance.

On the contrary, a tip seal fitted to the other scroll element which is engaged with a scroll element made of an aluminum material and is made hard by surface treatment, etc., is made of a composite plastic material of a lowered carbon fiber composition rate and has a lowered hardness.

As a result of the former, the tip seal of the scroll element made of an aluminum material is reduced in wear amount otherwise caused by the opposite inner surface of the end plate of the other scroll having a surface treatment, etc.

And as a result of the latter, the end plate of the scroll element made of an aluminum material is reduced in wear amount on the inner surface otherwise caused by sliding contact with the opposite tip seal.

Thereby the wear amount of each engaging tip seal and end plate is reduced, and simultaneously the degree of growth of the wearing of both components is caused to be equalized.

By the above, the life of the product is no longer hurt, and the reliability of the product is enhanced. Furthermore, according to the present invention, a good effect in reducing the wear amount is obtained, the effect of reducing the wear amount to meet the character of the tip seal material is obtained.

BRIEF DESCRIPTION OF THE DRAWINGS

In the accompanying drawings:

FIG. 2 is a table showing compositions of materials of tip seals fitted to a stationary scroll and a swivel scroll of the compressor of a preferred embodiment, together with materials of a scroll engaged therewith.

FIG. 5 is a table showing compositions of materials of tip seals fitted to the scroll type compressor of the prior art, together with materials of a scroll engaged therewith.

DESCRIPTION OF THE PREFERRED EMBODIMENTS

Figure 1:
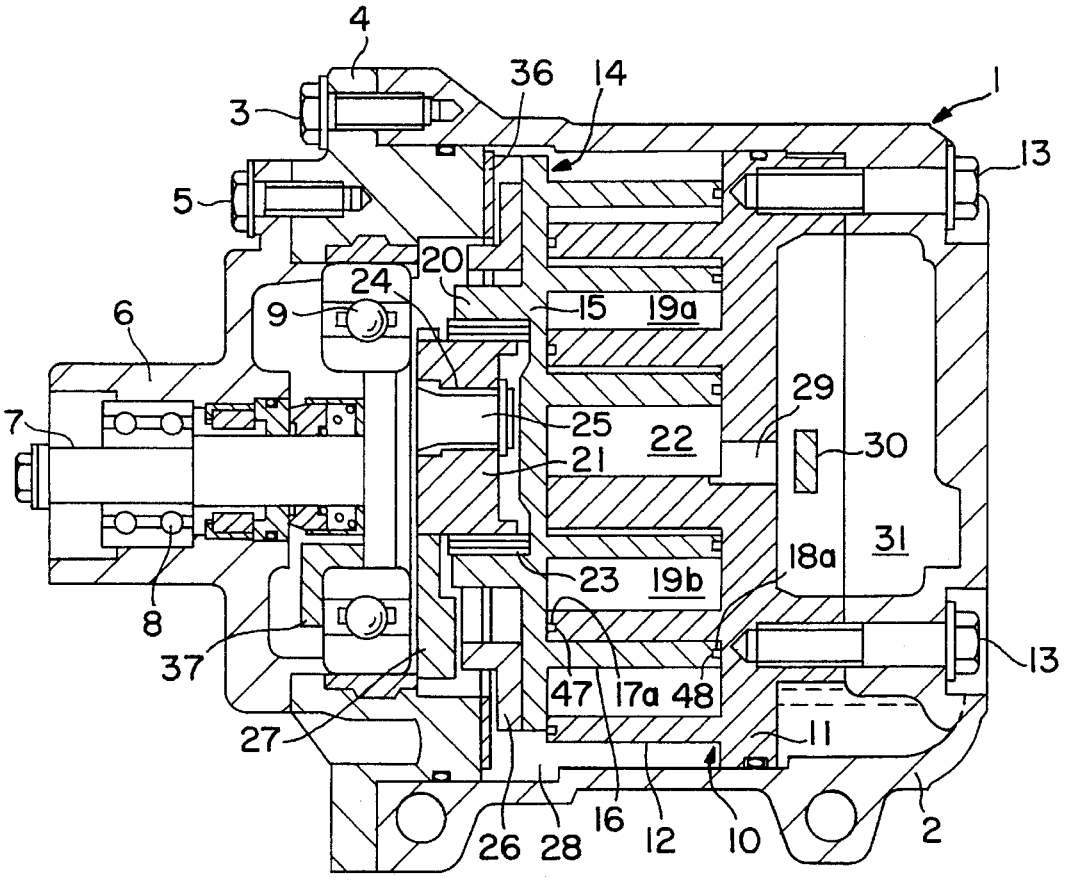
FIG. 1 is a cross section showing a scroll type compressor of a preferred embodiment according to the present invention.
Figure 3:
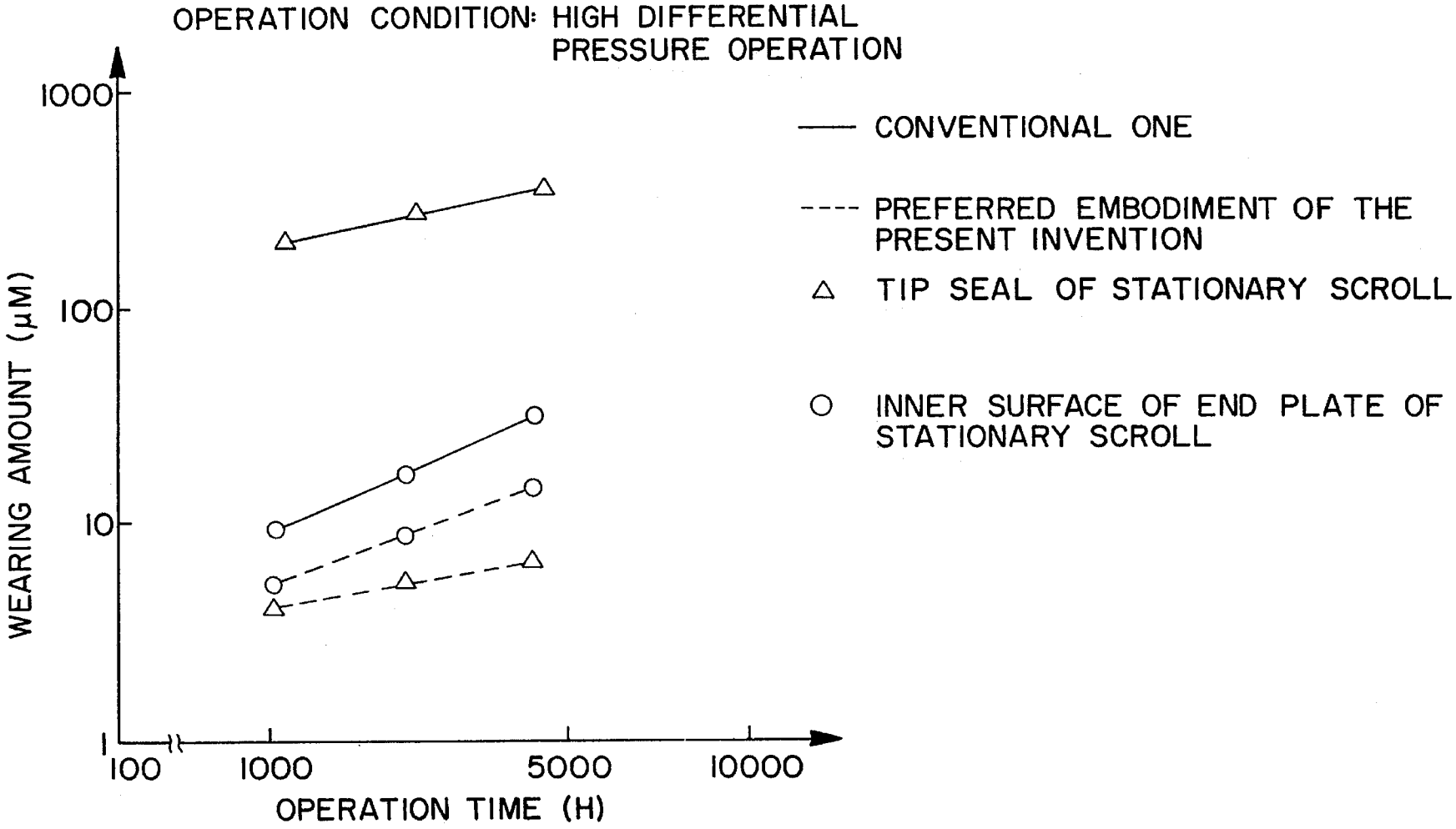
FIG. 3 is a graph showing, in comparison, wear amounts of a tip seal of a stationary scroll and of an inner surface of an end plate of a stationary scroll, in high differential operation tests, of a compressor using tip seals of changed carbon fiber composition rates and of a compressor using tip seals of the same composition as heretofore used.
Figure 4:
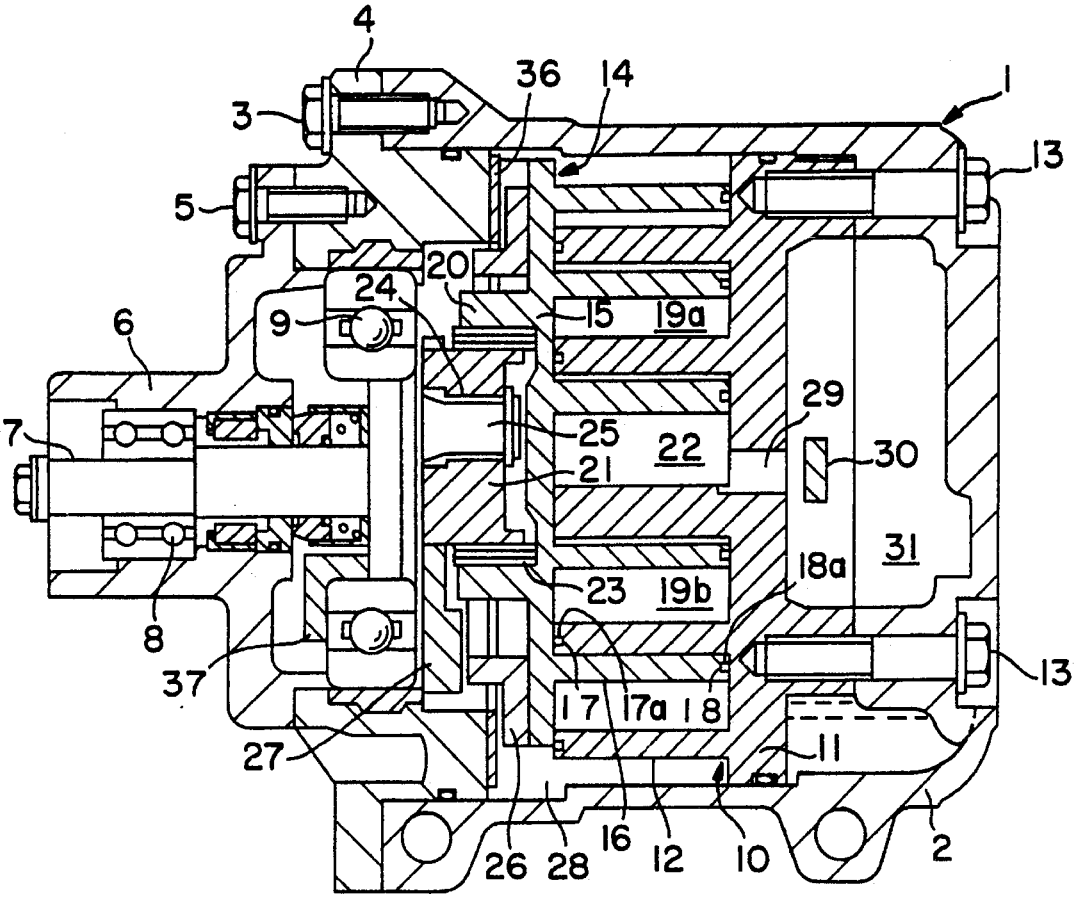
FIG. 4 (PRIOR ART)
FIG. 4 is a cross section explaining a construction of a scroll type compressor of the prior art.

The present invention is described below based on a preferred embodiment as shown in FIG. 1 to FIG. 3.

Incidentally, in this preferred embodiment, component parts that are the same as those mentioned in the above description are given the same reference numerals, and further explanation thereof will be omitted, and different elements (features of the invention) are described here.

A scroll type compressor according to the present invention differs from the prior art in using tip seals 17, 18 made of a composite plastic material of a different composition. For a purpose of distinction from tip seals 17, 18 of the prior art, a tip seal fitted to the stationary scroll 10 is designated by numeral 47 and a tip seal fitted to the swivel scroll 14 is designated by numeral 48.

According to the present invention, the carbon fiber composition rate of the tip seal material of a scroll element made of an aluminum material, i.e. the carbon fiber composition rate of the material of the tip seal 47 fitted to the stationary scroll 10, is made higher than the carbon fiber composition rate of the tip seal material of the other hard scroll element, i.e. the carbon fiber composition rate of the material of the tip seal 48 fitted to the swivel scroll 14.

More concretely, while the tip seal 17 of the conventional stationary scroll 10 and the tip seal 18 of the conventional swivel scroll 14, as described previously, are both made of a composite plastic material of the same composition, composed of a polyphenylene sulfide (PPS) as a base material, and a carbon fiber of 15 weight percent and other materials as a filler, as show in FIG. 5, the tip seal 47 of the stationary scroll 10 and the tip seal 48 of the swivel scroll 14 of this preferred embodiment are different in the material composition. E.g. as shown in FIG. 2, the tip seal material of the stationary scroll 10 made of an aluminum material has a higher carbon fiber composition rate of 20 weight percent, and the tip seal material of the swivel scroll 14 applied by a surface treatment on an aluminum material has a lower carbon fiber composition rate of 10 weight percent.

Incidentally, the swivel scroll 14 has on its surface an aluminum material by an alumite treatment (aluminum is anodized and aluminum oxide coating is formed on the surface) or by a special alumite treatment (aluminum is anodized, aluminum oxide coating is formed on the surface and a fluororesin etc. is impregnated on the surface) (surface treatment and hard coating treatment), thus a hard coating is formed on the surface of the swivel scroll 14 made of an aluminum material.

By so changing the carbon fiber composition rate, the wearing of the tip seal 47 of the stationary scroll 10 and of the inner surface of the end plate of the stationary scroll 10 can be reduced, and yet the wearing amount of said tip seal 47 and of the inner surface of the end plate can be equalized.

These effects are confirmed by experiments. In the experiments, a scroll type compressor of the prior art, in which tip seals 17, 18 made of a composite plastic material of same composition (composed of a polyphenylene as a base material and a carbon fiber of 15 weight percent and others as a filler) are incorporated, and a scroll type compressor of this preferred embodiment according to the present invention in which tip seals 47, 48 in which the material composition is different between the stationary scroll 10 and the swivel scroll 14 are incorporated, are operated in a high differential pressure operation (compression operation with a large differential pressure between the discharge pressure and the suction pressure). The wear amounts of the tip seals 17, 47 of each compressor and of the inner surface of the stationary scroll 10 of each compressor, after passing a certain operation time, are measured. The results of the experiments are shown in FIG. 3.

From FIG. 3, it is found that, by changing the carbon fiber composition rate, in comparison with the wear amounts of the tip seal 17 of the stationary scroll 10 and of the inner surface of the end plate of the stationary scroll 10, both in a conventional scroll type compressor, the wear amounts of the tip seal 47 of the stationary scroll 10 and of the inner surface of the stationary scroll 10, both in this preferred embodiment according to the present invention, are far smaller, and yet the growth of wear of both components is nearly to the same degree.

According to the experiments, not limited to the above-described carbon fiber composition rate, in the range of the carbon fiber composition rate of the material of the tip seal 47 fitted to the stationary scroll 10 of 17 to 50 weight percent, and in the range of the carbon fiber composition rate of the material of the tip seal 48 fitted to the swivel scroll 14 of 3 to 12 weight percent, the same excellent effect of reducing the wear amount can be obtained.

Such reduction of the wear amount of the tip seal 47, i.e. the reduction of the wear amount of the tip seal 47 otherwise caused by the worsened surface roughness and the hard surface of the opposite inner surface of the end plate of the swivel scroll 14 having a surface treatment, is brought about presumably by an increased hardness and an enhanced wear resistance of the tip seal material, with its carbon fiber composition rate being enhanced.

The reduction of the wear amount of the inner surface of the end plate of the stationary scroll 10, i.e. the reduction of the wear amount of the inner surface of the end plate otherwise caused by the sliding content with the tip seal 48, is brought about presumably by a lowered hardness of the material of the tip seal 48, with its carbon fiber composition rate being lowered.

Such reduction of the wear amount acts presumably to induce the growth of wear between each engaging tip seal 47, 48 and end plate 11, 15 of each scroll 10, 14 to be equalized.

If a swivel scroll 14 having a hard coating treatment on its surface is employed, an excellent effect of reducing the wear amount to meet the character of the tip seal material can be brought. Especially if this treatment is an alumite treatment (aluminum is anodized and aluminum oxide coating is formed on the surface) or a special alumite treatment (aluminum is anodized, aluminum oxide coating is formed on the surface and a fluororesin etc. is impregnated on the surface), a further effect of reducing the wear amount to meet the character of the tip seal material can be obtained.

Needless to mention, the swivel scroll 14 is not limited to that made of an aluminum material having a surface treatment, but one made of a hard ferrous metal or of a ferrous metal having a surface treatment give the same effect.

Incidentally, the preferred embodiment is described with the example of a pair of mutually engaged scrolls in which a stationary scroll 10 is made of an aluminum material. But if a swivel scroll 14 is made of an aluminum material and a stationary scroll 10 is made of an aluminum material with a surface treatment or made of a ferrous metal or made of a ferrous metal having a surface treatment, the same effect is obtained.

Further, needless to mention, the present invention is applied to a scroll type compressor, but not being limited thereto, it can also be applied to other scroll type fluid machines.

According to the present invention as described above, the wear amount between each engaging tip seal and end plate, which has so far been a problem in pairs of mutually engaged scroll elements, one being made of an aluminum material and the other having a hard surface treatment, can be reduced.

And yet, the growth of wear both of the engaging tip seal and the inner surface of the end plate can be equalized, and thus a disadvantage of the prior art where the wear of one scroll grows more quickly than the other can be suppressed.

As a result, the life of the product is no longer uselessly hurt, and the reliability of the product can be increased. An excellent effect of reducing the wear amount can be obtained in addition to the above effect of the invention. According to the present invention an excellent effect of reducing the wear amount can be made to meet the character of the tip seal material, in addition to the above effect of the invention.

While a preferred form of the present invention has been described, variations thereto will occur to those skilled in the art within the scope of the present invention concepts, which are delineated by the following claims.

What is claimed is:

1. A pair of scroll elements in a scroll fluid machine comprising:

a first scroll element comprising a first spiral wrap standing on one surface of a first end plate, said first scroll element being made of an aluminum material;

a second scroll element comprising a second spiral wrap standing on one surface of a second end plate, said second scroll element being made of one selected from the group consisting of an aluminum material having a surface treatment, and ferrous metal, and a ferrous metal having a surface treatment, wherein said first and second scroll elements area engaged with each other so as to have said first and second spiral wraps 180 degrees out of phase with respect to each other and so as to form fluid cambers therebetween;

a first groove in a tip surface of said first spiral wrap of said first scroll element having a first tip seal therein made of a composite plastic material composed of a polyphenylene sulfide as a base material and a carbon fiber and other materials as filler; and a second groove in a tip surface of said second spiral wrap of said second scroll element having a second tip seal therein made of a composite plastic material composed of a polyphenylene sulfide as a base material and a carbon fiber and other material as filler;

wherein the carbon fiber composition rate of said composite plastic material of said first tip seal is higher than the carbon fiber composition rate of said composite plastic material of said second tip seal.

2. The scroll type fluid machine of claim 1, wherein the carbon fiber composition rate of said composite plastic material of said first tip seal is 17 to 50 weight percent and the carbon fiber composition rate of said composite plastic material of said second tip seal is 3 to 12 weight percent.

3. The scroll type fluid machine of claim 1, wherein said second scroll element comprises a material having a hard coating surface treatment.

4. The scroll type fluid machine of claim 3, wherein said second scroll element comprises an aluminum material having an alumite treatment.

* * * * *